US011369217B2

(12) United States Patent
Yaguda

(10) Patent No.: US 11,369,217 B2
(45) Date of Patent: Jun. 28, 2022

(54) IN-STORE RECONFIGURABLE SELF-CHECKOUT BAGGING APPARATUS AND RELATED STRUCTURES

(71) Applicant: Toshiba Global Commerce Solutions Holdings Corporation, Tokyo (JP)

(72) Inventor: Nancy Yaguda, Apex, NC (US)

(73) Assignee: TOSHIBA GLOBAL COMMERCE SOLUTIONS HOLDINGS CORPORATION, Tokyo (JP)

( * ) Notice: Subject to any disclaimer, the term of this patent is extended or adjusted under 35 U.S.C. 154(b) by 357 days.

(21) Appl. No.: 16/835,734

(22) Filed: Mar. 31, 2020

(65) Prior Publication Data

US 2021/0298496 A1 Sep. 30, 2021

(51) Int. Cl.
*A47F 10/02* (2006.01)

(52) U.S. Cl.
CPC ..... *A47F 10/02* (2013.01)

(58) Field of Classification Search
CPC ..... A47F 10/02; A47F 9/042
USPC ..... 186/66; 235/383
See application file for complete search history.

(56) References Cited

U.S. PATENT DOCUMENTS 3,557,907 A * 1/1971 Close ..... A47F 9/042 53/390
2004/0041021 A1 3/2004 Nugent, Jr.

* cited by examiner

*Primary Examiner* — Russell S Glass
(74) *Attorney, Agent, or Firm* — Stanek Lemon Crouse & Meeks, P.A.

(57) ABSTRACT

A self-checkout system can include a re-configurable self-checkout bagging station that further includes a bagging station module that can be configured to mate with a stand-alone bagging station module, where the stand-alone bagging station module configured to couple to first and second interfaces of a self-checkout system terminal, respectively. A wedge shaped bagging station extension module surface can be configured to couple to the bagging station module in a left-oriented oblique self-checkout system configuration in a first position of the wedge shaped bagging station extension module surface and can be re-configurable from the first position to a second position of the wedge shaped bagging station extension module surface to couple to the bagging station module in a right-oriented oblique self-checkout system configuration.

17 Claims, 5 Drawing Sheets

IN-STORE RECONFIGURABLE SELF-CHECKOUT BAGGING APPARATUS AND RELATED STRUCTURES

FIELD

The present invention relates to the field of point of sale systems in general, and more particularly, to bagging systems for point of sale systems.

BACKGROUND

Self-checkout systems are commonly used by consumers at retail locations such as grocery stores. In operation, the user can scan items at the self-checkout system and place the scanned items into a bag located on a scale of the self-checkout system. When the item is scanned, the self-checkout system accesses data that indicates information about the scanned item, such as a specified weight. The self-checkout system can then compare the specified weight with the measured weight provided by the scale. In this way, the self-checkout system can verify that the scanned items are the ones placed into the bag.

SUMMARY

Embodiments according to the present invention can provide methods in-store reconfigurable self-checkout bagging apparatus and related structures. Pursuant to these embodiments, a self-checkout system can include a reconfigurable self-checkout bagging station that further includes a bagging station module that can be configured to mate with a stand-alone bagging station module, where the stand-alone bagging station module configured to couple to first and second interfaces of a self-checkout system terminal, respectively. A wedge shaped bagging station extension module surface can be configured to couple to the bagging station module in a left-oriented oblique self-checkout system configuration in a first position of the wedge shaped bagging station extension module surface and can be reconfigurable from the first position to a second position of the wedge shaped bagging station extension module surface to couple to the bagging station module in a right-oriented oblique self-checkout system configuration.

In some embodiments, a self-checkout system can include a stand-alone bagging module that can be configured to re-moveably couple with a self-checkout terminal at a first interface on a first side of the self-checkout terminal and configured to re-moveably couple with the self-checkout terminal at a second interface on a second side of the self-checkout terminal that is on an opposite side of the self-checkout terminal in a first direction. A bagging module extension can be configured to couple to the stand-alone bagging module and a wedge shaped bagging module extension surface can include a first edge of the wedge shaped bagging module extension surface that is coupled to the bagging module extension in a left-oriented oblique self-checkout system configuration. A second edge of the wedge shaped bagging module extension surface can face in an oblique direction relative to first edge that is coupled to the bagging module extension in a left-oriented oblique self-checkout system configuration.

In some embodiments, a self-checkout system can include a re-configurable self-checkout bagging station including a wedge shaped bagging station extension module surface reconfigurable in a left-oriented oblique self-checkout system configuration in a first position of the wedge shaped bagging station extension module surface and in a right-oriented oblique self-checkout system configuration in a second position of the wedge shaped bagging station extension module surface.

DETAILED DESCRIPTION OF EMBODIMENTS ACCORDING TO THE INVENTION

Figure 2:
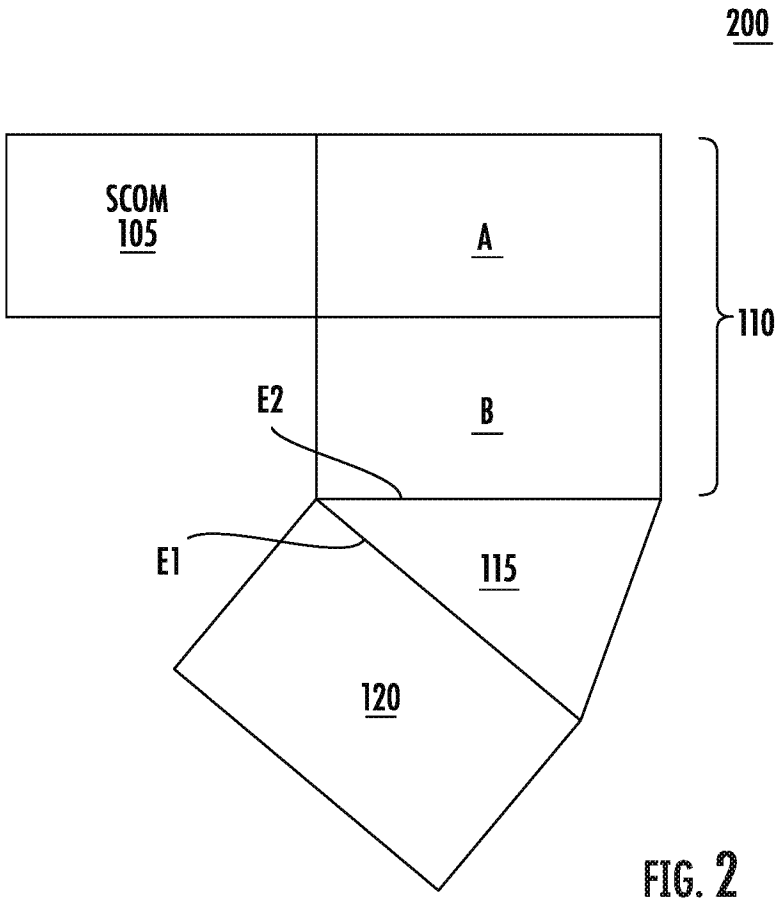
FIG. 2 is a block diagram of a self checkout system including a wedge shaped bagging station extension module in a right oriented oblique self checkout system configuration having been reconfigured from the configuration shown in FIG. 1 in some embodiments according to the invention.

Exemplary embodiments of the present disclosure are described in detail with reference to the accompanying drawings. The disclosure may, however, be exemplified in many different forms and should not be construed as being limited to the specific exemplary embodiments set forth herein. Rather, these exemplary embodiments are provided so that this disclosure will be thorough and complete, and will fully convey the scope of the disclosure to those skilled in the art.

As appreciated by the present inventors, some commercial operators have a need to reorganize existing self checkout lanes due to changes in business patterns and/or customer preferences. For example, some commercial operators, such as large retailers, have a need to reorganize previously installed self checkout terminals and bagging systems to increase utilization of floor space or to improve customer throughput at checkout. However, certain design choices can require customers to order additional parts (or new entire configurations) in order to realize these improvements in efficiency.

Accordingly, in some embodiments according to the invention a self checkout bagging system can address the above issues by adopting a modular approach to the spatial issues raised by the changes desired by the operators so that the self checkout systems can be reconfigured by reorienting some of the already included modules. For example, when ergonomic (i.e., angled) self-checkout systems are to be changed from left orientation to right orientation, the ergonomic aspect can be preserved in the right orientation when reconfiguring the lanes by using a wedge shaped bagging station module in the bagging system design. The surface edges of the wedge shaped bagging station module can be configured to couple with either of the other modules that are adjacent to the wedge shaped bagging station module without introducing new parts or replacing existing parts.

In some embodiments according to the invention the wedge shaped bagging station module can be rotated so that the surface edges that are coupled to adjacent ones of the bagging station modules when in the left oriented configuration are coupled to the opposite module in the right oriented configuration while still providing the desired ergonomic angle (and without the need for buying new parts). In some embodiments, this reconfiguration can be accomplished by rotating the surface of the wedge shaped module (which can be detached from the underlying structure) 180 degrees in the horizontal whereas in other embodiments the surface of the wedge shaped module may be flipped 180 in the vertical. Accordingly, both of the surface edges of the wedge shaped module can couple to either the module that is upstream or the module that is downstream. In the other embodiments, the surface edge of the wedge shaped module is recoupled to the same upstream or downstream module by flipping the surface of the wedge shaped module over.

In still other embodiments the wedge shape surface can be provided by the connecting two panels that underlap the surfaces of each of the adjacent modules in the bagging system such that both panels can be rotated in the horizontal to reconfigure the bagging system in the left of the right configuration. In such embodiments, the exposed portions of the panels can define a wedge shape due to the orientation of upper surfaces of each of the adjacent modules. In still further embodiments, the wedge shape of the upper surface of the bagging system is provided by a plurality of articulating fan segments.

Figure 1:
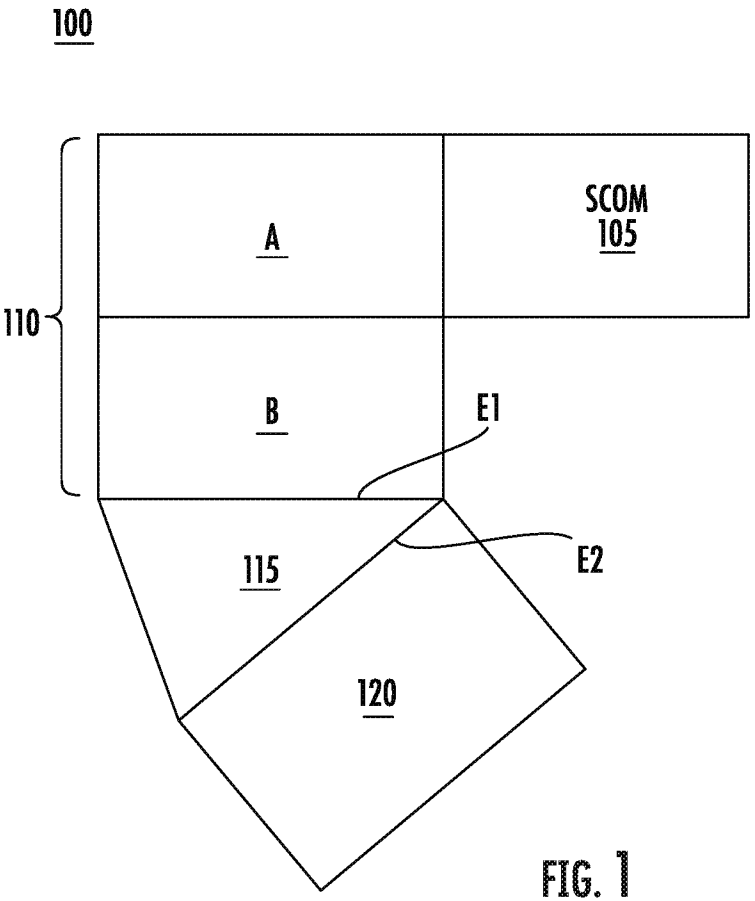
FIG. 1 is a block diagram of a reconfigurable self checkout system including a wedge shaped bagging station extension module in a left oriented oblique self checkout system configuration in some embodiments according to the invention.

FIG. 1 is a block diagram of a reconfigurable self checkout system 100 including a wedge shaped bagging station extension module 115 in a left oriented oblique self checkout system configuration in some embodiments according to the invention. The reconfigurable self checkout system 100 can further include a bagging station module 110B that is upstream from the wedge shaped bagging station extension module 115 module and a bagging station extension module 120 that is downstream from the wedge shaped bagging station extension module 115. As further shown in FIG. 1, the bagging station module 110B can be included in what is referred to as a stand-alone bagging station 110, which can also include a bagging station module 110A that is adjacent to a side surface of a self checkout terminal 105. It will be understood that the systems 100 and 200 shown in FIGS. 1 and 2 may include more modules or fewer modules in some embodiments.

The bagging station module 110A can be used with the self checkout system 100 in a standalone configuration or in conjunction with the bagging station module 110B (which together may provide the bagging station module 110). The bagging station module 110B may serve to extend the footprint of the self checkout system 100 perpendicular to the bagging station module 110A so that the downstream modules may provide a more ergonomic interface for the customer, particularly with regard to the angle provided by wedge shaped bagging station extension module 115 to the downstream modules. In still other embodiments, the bagging station modules 110A and 110B can be provided as an integrated or unitary structure. The self checkout terminal 105 can be used by a customer to checkout by paying for the items that are bagged in the bagging system. It will be understood that the bagging system 110 can include both of modules 110A and 110B.

As further shown in FIG. 1, the wedge shaped bagging station extension module 115 is removably coupled to the bagging station module 110B at a surface edge E1 of the wedge shaped bagging station extension module 115. The wedge shaped bagging station extension module 115 is also removably coupled to the bagging station extension module 120 at a surface edge E2 of the wedge shaped bagging station extension module 115. It will be understood that the first and second surface edges E1 and E2 can be decoupled from the upstream and downstream modules in order to change the reconfigurable self checkout system 100 to the left oriented configuration or the right oriented configuration. In operation, the customer uses the self checkout terminal 105 to scan the items, which are then bagged and placed on the surface of the bagging station module 110. The bagging station module 110B and the downstream modules (i.e., the wedge shaped bagging station extension module 115 and the bagging station extension module 120) allow the customer to continue to bag relatively large orders in an ergonomic fashion as the self checkout process proceeds.

The angle defined by the positions of the surface edges E1 and E2 of the wedge shaped bagging station extension module 115 can be any oblique angle that provides an ergonomic experience for the customer during the self checkout process. Still further the position at which the bagging station module 110B couples to the wedge shaped bagging station extension module 115 can also affect the ergonomic experience for the customer.

FIG. 2 is a block diagram of a self checkout system 200 including the wedge shaped bagging station extension module 115 in a right oriented oblique self checkout system configuration having been reconfigured from the configuration shown in FIG. 1 in some embodiments according to the invention. According to FIG. 2, the bagging station module 110 is moved to the opposite side of the self checkout terminal 105 so that the same interface is presented to the downstream modules. Accordingly, the bagging station module 110 can interface to the self checkout terminal 105 via either of the side surfaces of the bagging station module 110.

The wedge shaped bagging station extension module 115 can be re-positioned in the right oriented oblique self checkout system configuration 200 by rotating the wedge shaped bagging station extension module 115 in the horizontal plane so that the surface edge E1 faces downstream, whereas the surface edge E2 now faces upstream to couple with the bagging station module 110. In some embodiments, the wedge shaped bagging station extension module 115 can be re-positioned in the right oriented oblique self checkout system configuration 200 by flipping the wedge shaped bagging station extension module 115 in the vertical plane so that the surface edge E1 still faces upstream to couple with the bagging station module 110, whereas the surface edge E2 still faces downstream despite being reconfigured from the left oriented oblique self checkout system configuration to the right oriented oblique self checkout system configuration. It will be understood that when the wedge shaped bagging station extension module 115 is flipped in the vertical plane, the lower surface of the wedge shaped bagging station extension module 115 (in the left oriented oblique self checkout system configuration) provides the upper surface (sometimes refer to as the bagging surface) of the wedge shaped bagging station extension module 115 (right oriented oblique self checkout system configuration).

Still referring to FIGS. 1 and 2, the bagging station extension module 120 can be re-positioned in the right oriented oblique self checkout system configuration 200 to coupled with the surface edge E2 (if facing downstream) or to the surface edge E1 (if facing downstream). Accordingly, in some embodiments according the bagging station extension module 120 is configured to couple with the surface edge E1 or the surface edge E2.

Figure 3:
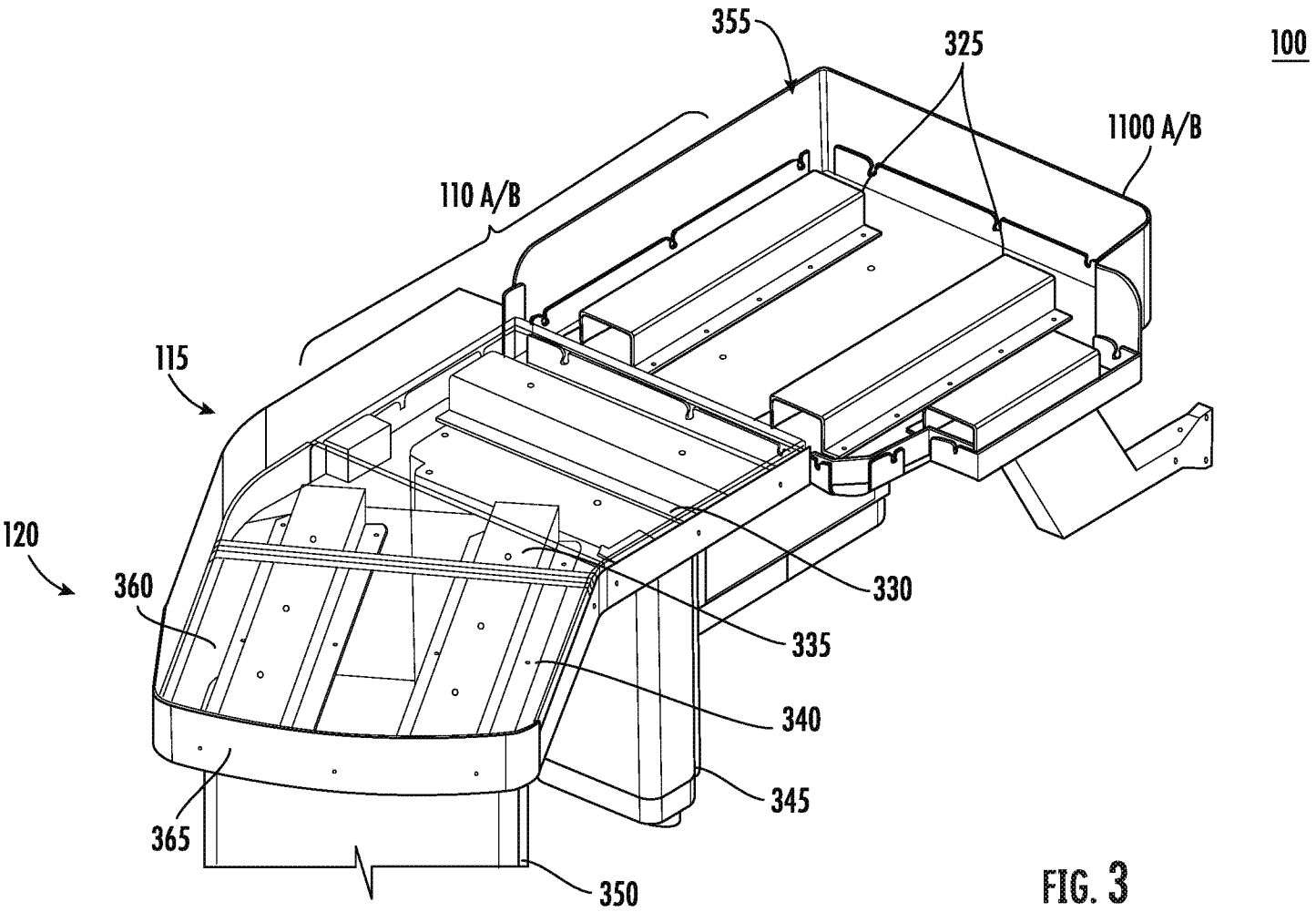
FIG. 3 is a detailed perspective view of a left oriented oblique self checkout system configuration including the wedge shaped bagging station extension module defined by overlapping pans in the wedge shaped bagging station extension module and in the bagging station extension end module in some embodiments according to the invention.
Figure 4A:
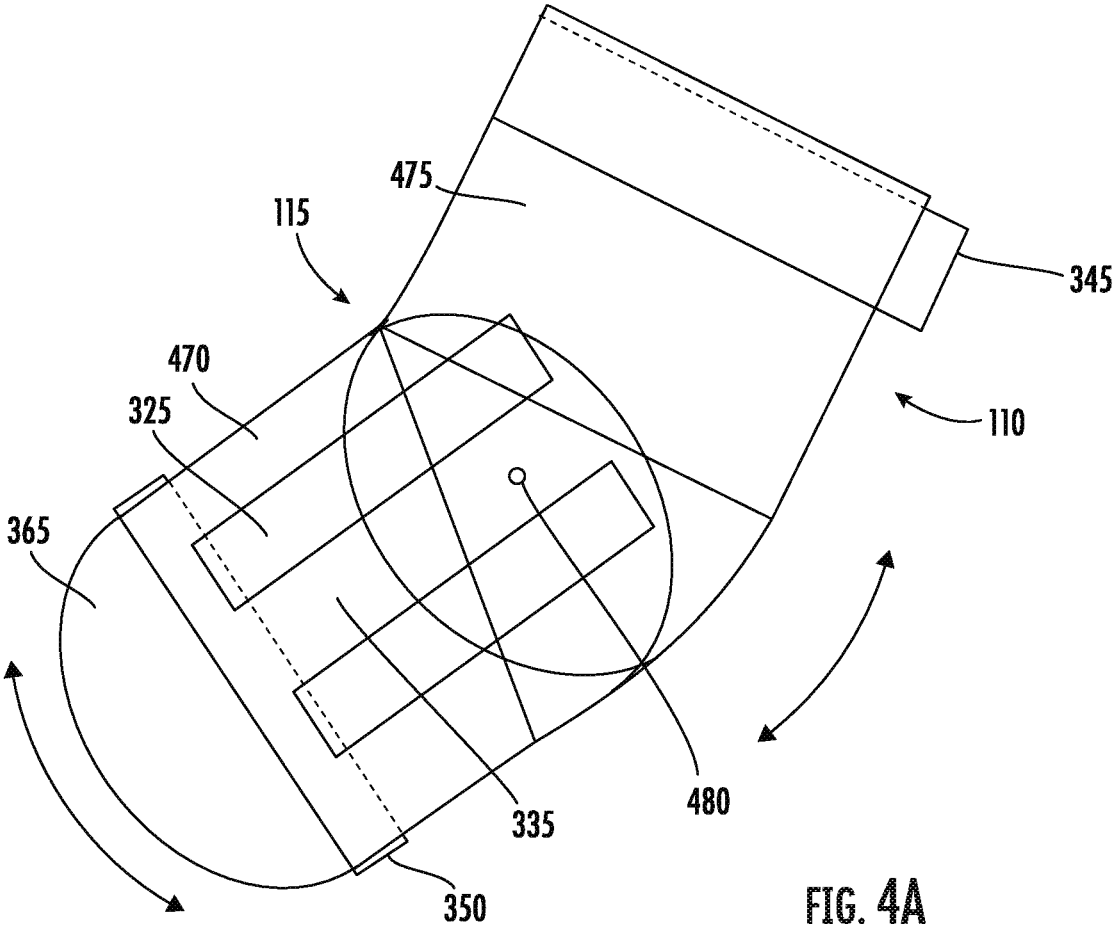
FIG. 4A is detailed a top schematic view of the exposed upper surface of the wedge shaped bagging station extension module defined by overlapping pans included in the bagging station extension end module and in the bagging station module in some embodiments according to the invention.
Figure 4B:
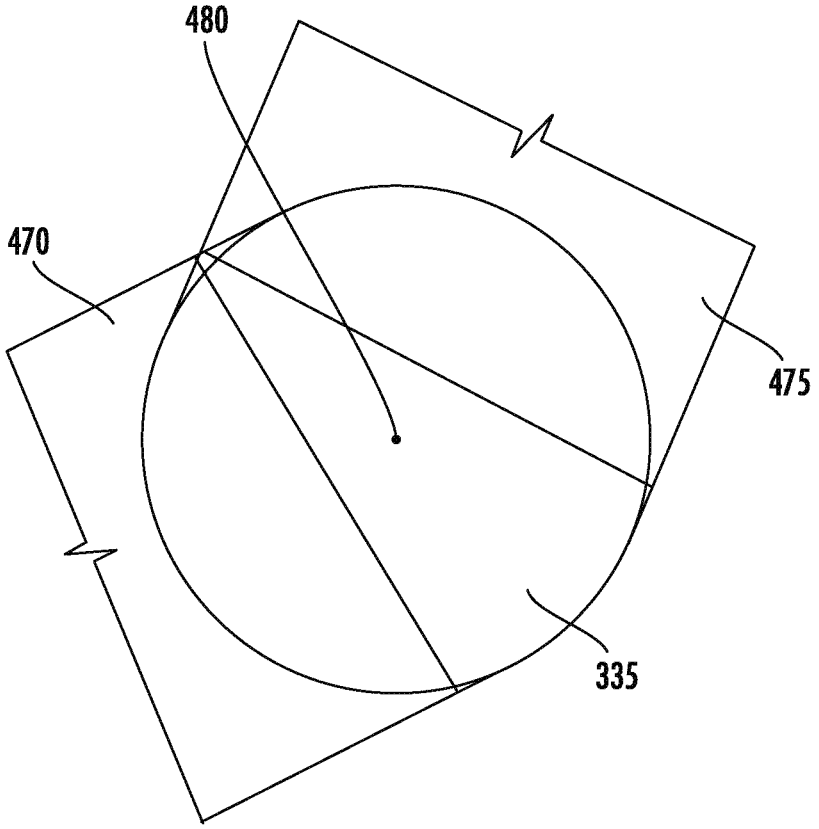
FIG. 4B is a simplified top schematic view of the apparatus shown in FIG. 4A in some embodiments according to the invention.

FIG. 3 is a detailed perspective view of a left oriented oblique self checkout system configuration 100 that includes overlapping pans 470 and 475 (in FIGS. 4A and 4B) shown below the surfaces 330, 335, and 360 of the bagging station module 110B, the wedge shaped bagging station extension module 115, and the bagging station extension module 120, respectively in some embodiments according to the invention. FIGS. 4A and 4B are a detailed top schematic view and a simplified top schematic view of the apparatus shown in FIG. 4A, respectively, of the exposed upper surface of the wedge shaped bagging station extension module defined by overlapping panels included in the bagging station extension end module and in the bagging station module in some embodiments according to the invention. According to FIG. 3, the pans are coupled together by a pin 480 that allows the overlapping pans 470 and 475 to rotate relative to one another while so that that the bagging station module 110B can remain coupled to the wedge shaped bagging station extension module 115 while the system is reconfigured to either the left or right oriented position. Furthermore, the pin 480 allows the oblique angle between the bagging station module 110B and the wedge shaped bagging station extension module 115 to be customized in some embodiments.

In still other embodiments, the overlapping pans 470 and 475 are located beneath the respective bagging surfaces of the bagging station module 110B and the bagging station extension module 120, but exposed beyond the edges of the respective modules to define the wedge shaped bagging station extension module 115 as the exposed portions of the overlapping pans 470 and 475.

As further shown in FIGS. 3 and 4A, and 4B, the system configuration 100 can include structural support pillars 345 and 350 that couple to and support the bagging station module 110B and the wedge shaped bagging station extension module 115. The system configuration 100 can also include structural support members 325 beneath the bagging station module 110B, the wedge shaped bagging station extension module 115, and the bagging station extension module 120. The structural support members 325 are separated by respective channels which can accommodate a load cell for the bagging system. The system configuration 100 can also include fences 355 which are secured along an outer edge of the bagging surface. When the system configuration is changed, the fences 335 can be removed and flipped over for mounting along the outer edge of the bagging surface in the newly oriented configuration.

Figure 5:
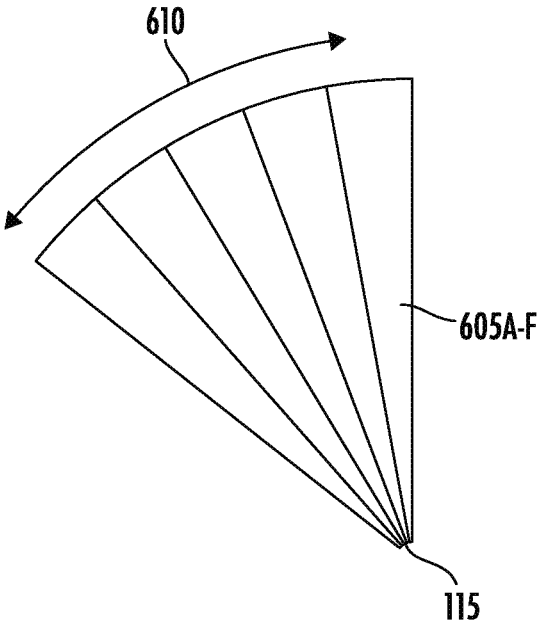
FIG. 5 is top a schematic view of the surface of the wedge shaped bagging station extension module defined by a plurality of articulating fans in some embodiments according to the invention.

FIG. 5 is top a schematic view of the bagging surface of the wedge shaped bagging station extension module 115 defined by a plurality of articulating fans 605A-F in some embodiments according to the invention. According to FIG. 5, the plurality of articulating fans 605A-F are moveable in the direction 610 to provide a variable oblique angle as described herein. When the system configuration is changed, the bagging surface of the wedge shaped bagging station extension module 115 can be removed and repositioned as described above. However, according to FIG. 6, the angle provided by the bagging surface of the wedge shaped bagging station extension module 115 can be adjusted by increasing or decreasing the degree of overlap provided by the plurality of articulating fans 605A-F. It will be understood that more or fewer articulating fans 605 may be used in some embodiments.

Figure 6:
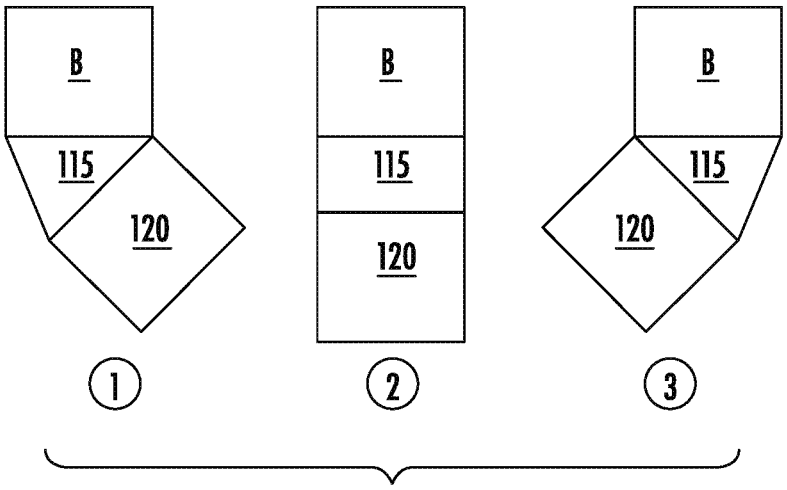
FIG. 6 is a schematic illustration of the process of re-configuring the left oriented oblique self checkout system configuration as the right oriented oblique self checkout system configuration in some embodiments according to the invention by moving the bagging station extension end module while coupled to the wedge shaped bagging station extension module in some embodiments according to the invention.

FIG. 6 is a schematic illustration of the process of re-configuring the left oriented oblique self checkout system configuration as the right oriented oblique self checkout system configuration in some embodiments according to the invention by moving the bagging station extension end module while coupled to the wedge shaped bagging station extension module in some embodiments according to the invention.

As described herein, as appreciated by the present inventor some commercial operators may have a need to reorganize existing self checkout lanes due to changes in business patterns and/or customer preferences. For example, some commercial operators, such as large retailers, have a need to reorganize previously installed self checkout terminals and bagging systems to increase utilization of floor space or to improve customer throughput at checkout. However, certain design choices can require customers to order additional parts (or new entire configurations) in order to realize these improvements in efficiency.

Accordingly, in some embodiments according to the invention a self checkout bagging system can address the above issues by adopting a modular approach to the spatial issues raised by the changes desired by the operators so that the self checkout systems can be reconfigured by reorienting some of the already included modules. For example, when ergonomic (i.e., angled) self-checkout systems are to be changed from left orientation to right orientation, the ergonomic aspect can be preserved in the right orientation when reconfiguring the lanes by using a wedge shaped bagging station module in the bagging system design. The surface edges of the wedge shaped bagging station module can be configured to couple with either of the other modules that are adjacent to the wedge shaped bagging station module without introducing new parts or replacing existing parts.

The terminology used herein is for the purpose of describing particular embodiments only and is not intended to be limiting to other embodiments. As used herein, the singular forms "a", "an" and "the" are intended to include the plural forms as well, unless the context clearly indicates otherwise. It will be further understood that the terms "comprises," "comprising," "includes" and/or "including", "have" and/or "having" when used herein, specify the presence of stated features, integers, steps, operations, elements, and/or components, but do not preclude the presence or addition of one or more other features, integers, steps, operations, elements, components, and/or groups thereof. Elements described as being "to" perform functions, acts and/or operations may be configured to or other structured to do so.

Unless otherwise defined, all terms (including technical and scientific terms) used herein have the same meaning as commonly understood by one of ordinary skill in the art to which various embodiments described herein belong. It will be further understood that terms used herein should be interpreted as having a meaning that is consistent with their meaning in the context of this specification and the relevant art and will not be interpreted in an idealized or overly formal sense unless expressly so defined herein.

While the foregoing is directed to aspects of the present disclosure, other and further embodiments of the disclosure may be devised without departing from the basic scope thereof, and the scope thereof is determined by the claims that follow.

What is claimed:

1. A self-checkout system comprising:

a re-configurable self-checkout bagging station including:

a bagging station module configured to mate with a stand-alone bagging station module, the stand-alone bagging station module configured to couple to first and second interfaces of a self-checkout system terminal, respectively; and a wedge shaped bagging station extension module surface configured to couple to the bagging station module in a left-oriented oblique self-checkout system configuration in a first position of the wedge shaped bagging station extension module surface and re-configurable from the first position to a second position of the wedge shaped bagging station extension module surface to couple to the bagging station module in a right-oriented oblique self-checkout system configuration.

2. The self-checkout system of claim 1 wherein the wedge shaped bagging station extension module surface includes first surface edge and a second surfaces edge facing in an oblique direction relative to the first surface edge; and wherein in the first position of the wedge shaped bagging station extension module surface, the first surface edge is coupled to the bagging station module and wherein in the second position of the wedge shaped bagging station extension module surface, the second surface edge is coupled to the bagging station module.

3. The self-checkout system of claim 1 wherein the wedge shaped bagging station extension module surface includes a first surface edge and a second surfaces edge facing in an oblique direction relative to the first surface edge; and wherein in the first position of the wedge shaped bagging station extension module surface, the first surface edge is coupled to the bagging station module and wherein in the second position of the wedge shaped bagging station extension module surface the first surface edge is coupled to the bagging station module.

4. The self-checkout system of claim 3 wherein in the first position an upper surface of the wedge shaped bagging station extension module surface is used as a bagging surface of the re-configurable self-checkout bagging station and in the second position an lower surface of the wedge shaped bagging station extension module surface, opposite the upper surface, is used as a bagging surface of the re-configurable self-checkout bagging station.

5. The self-checkout system of claim 1 further comprising:

a bagging station extension end module configured to couple to the wedge shaped bagging station extension module surface in the first position to further extend the left-oriented oblique self-checkout system configuration and configured to couple to the wedge shaped bagging station extension module surface in the second position to further extend the right-oriented oblique self-checkout system configuration.

6. The self-checkout system of claim 5 wherein the bagging station extension end module includes a first surface edge and a second surface edge facing in an opposite direction relative to the first surface edge; and wherein in a first position of the bagging station extension end module, the first surface edge is coupled to the wedge shaped bagging station extension module surface and wherein in the second position the second surface edge is coupled to wedge shaped bagging station extension module surface.

7. The self-checkout system of claim 1 wherein wedge shaped bagging station extension module surface is reconfigured from the left-oriented oblique self-checkout system configuration to the right-oriented oblique self-checkout system configuration by rotating the wedge shaped bagging station extension module surface from the first position to the second position while coupled to the bagging station module.

8. The self-checkout system of claim 7 wherein the wedge shaped bagging station extension module surface includes a panel that extends beneath a bagging surface of the bagging station module and the panel is secured by a first pin that extends through the panel beneath the bagging surface defined by an exposed surface.

9. The self-checkout system of claim 8 wherein the wedge shaped bagging station extension module surface is defined by a portion of the panel that is exposed from beneath the bagging surface.

10. The self-checkout system of claim 9 further comprising:

a bagging station extension end module coupled to the pan, wherein the panel extends beneath a bagging surface of the bagging station extension end module secured by a second pin that extends through the panel beneath the bagging surface of the bagging station extension end module to further define the wedge shaped bagging station extension module surface.

11. The self-checkout system of claim of 1 wherein the stand-alone bagging station module is configured to operate with the self-checkout system terminal independently of the bagging station module and independently of the wedge shaped bagging station extension module surface.

12. The self-checkout system of claim 7 wherein the wedge shaped bagging station extension module surface is defined by a plurality of articulating fan segments that move relative to one another when changing from the left-oriented oblique self-checkout system configuration to the right-oriented oblique self-checkout system configuration.

13. The self-checkout system of claim 1 wherein the re-configurable self-checkout bagging station is re-configurable from the left-oriented oblique self-checkout system configuration to the right-oriented oblique self-checkout system configuration in-situ without replacing components of the re-configurable self-checkout bagging station.

14. A self-checkout system comprising:

a re-configurable self-checkout bagging station including a wedge shaped bagging station extension module surface reconfigurable in a left-oriented oblique self-checkout system configuration in a first position of the wedge shaped bagging station extension module surface and in a right-oriented oblique self-checkout system configuration in a second position of the wedge shaped bagging station extension module surface.

15. The self-checkout system of claim 14 wherein the re-configurable self-checkout bagging station is re-configurable from the left-oriented oblique self-checkout system configuration to the right-oriented oblique self-checkout system configuration in-situ without replacing components of the re-configurable self-checkout bagging station.

16. The self-checkout system of claim 14 wherein the re-configurable self-checkout bagging station is re-configurable from the left-oriented oblique self-checkout system configuration to the right-oriented oblique self-checkout system configuration without decoupling the wedge shaped bagging station extension module surface from a remainder of the self-checkout system.

17. A self-checkout system comprising:

a stand-alone bagging module configured to re-moveably couple with a self-checkout terminal at a first interface on a first side of the self-checkout terminal and configured to re-moveably couple with the self-checkout terminal at a second interface on a second side of the self-checkout terminal that is on an opposite side of the self-checkout terminal in a first direction;

a bagging module extension configured to couple to the stand-alone bagging module;

a wedge shaped bagging module extension surface including:

a first edge of the wedge shaped bagging module extension surface that is coupled to the bagging module extension in a left-oriented oblique self-checkout system configuration; and a second edge of the wedge shaped bagging module extension surface that faces in an oblique direction relative to first edge that is coupled to the bagging module extension in a left-oriented oblique self-checkout system configuration.

* * * * *